US007938763B2

(12) United States Patent
Campanaro et al.

(10) Patent No.: US 7,938,763 B2
(45) **Date of Patent: *May 10, 2011**

(54) INCLINABLE EXERCISE DEVICE WITH ABDOMINAL CRUNCH EXERCISE ACCESSORY APPARATUS AND METHOD

(75) Inventors: Thomas J. Campanaro, Ranch Santa Fe, CA (US); Charles Joseph Mahon, Downington, PA (US); Dan McCutcheon, San Diego, CA (US)

(73) Assignee: Engineering Fitness International Corp., San Diego, CA (US)

( * ) Notice: Subject to any disclaimer, the term of this patent is extended or adjusted under 35 U.S.C. 154(b) by 41 days.

This patent is subject to a terminal disclaimer.

(21) Appl. No.: 12/687,330

(22) Filed: Jan. 14, 2010

(65) Prior Publication Data

US 2010/0227748 A1 Sep. 9, 2010

Related U.S. Application Data

(60) Provisional application No. 61/158,045, filed on Mar. 6, 2009.

(51) Int. Cl.
*A63B 26/00* (2006.01)

(52) U.S. Cl. ..... 482/140

(58) Field of Classification Search ..... 482/140, 482/142, 907–908, 139; D21/676, 696, 686, D21/662

See application file for complete search history.

(56) References Cited

U.S. PATENT DOCUMENTS

| | | | | | |
|---|---|---|---|---|---|
| 3,658,327 | A | * | 4/1972 | Thiede | 482/96 |
| 4,004,801 | A | * | 1/1977 | Campanaro et al. | 482/96 |
| 4,101,124 | A | * | 7/1978 | Mahnke | 482/96 |
| 4,383,684 | A | * | 5/1983 | Schliep | 482/96 |
| D289,882 | S | | 5/1987 | Gringer | |
| 4,706,953 | A | * | 11/1987 | Graham | 482/96 |
| 4,911,438 | A | * | 3/1990 | Van Straaten | 482/96 |
| 5,169,363 | A | * | 12/1992 | Campanaro et al. | 482/96 |
| 5,224,914 | A | | 7/1993 | Friedman | |
| D364,902 | S | | 12/1995 | Fleming | |
| 5,545,114 | A | | 8/1996 | Gvoich | |
| D381,378 | S | | 7/1997 | Colonello et al. | |
| D383,811 | S | | 9/1997 | Ho | |
| D385,930 | S | | 11/1997 | Chen | |
| 5,725,463 | A | | 3/1998 | Colonello et al. | |
| 5,752,901 | A | | 5/1998 | Lee | |
| D405,132 | S | * | 2/1999 | Westfall et al. | D21/676 |
| D408,477 | S | | 4/1999 | Arnold et al. | |
| 5,938,571 | A | * | 8/1999 | Stevens | 482/96 |
| 5,967,955 | A | * | 10/1999 | Westfall et al. | 482/142 |

(Continued)

FOREIGN PATENT DOCUMENTS

JP D1091689 11/2000

(Continued)

*Primary Examiner* — Lori Baker
(74) *Attorney, Agent, or Firm* — Stephen C. Beuerle; Procopio Cory Hargreaves & Savitch LLP

(57) ABSTRACT

A pair of abdominal crunch boards attachable side-by-side to an adjustable incline of an inclinable exercise device provide arm rests and hand grips for a user performing abdominal crunch exercises while positioned on a user support of the inclinable exercise device. Each abdominal crunch board includes a handle bar connected to a support frame which supports a padded board and which includes a fastener mechanism configured for releasable attachment to the adjustable incline.

22 Claims, 11 Drawing Sheets

U.S. PATENT DOCUMENTS

| | | | | |
|---|---|---|---|---|
| 6,117,055 | A | 9/2000 | Boland | |
| 6,117,057 | A | 9/2000 | Olschansky et al. | |
| 6,186,926 | B1 | 2/2001 | Ellis | |
| 6,220,995 | B1 | 4/2001 | Chen | |
| 6,390,960 | B1 | 5/2002 | Boland | |
| D476,384 | S | 6/2003 | Perez | |
| D476,921 | S | 7/2003 | Mehrmann et al. | |
| D493,853 | S * | 8/2004 | Campanaro et al. | D21/676 |
| D496,701 | S | 9/2004 | Chung | |
| 6,921,355 | B2 * | 7/2005 | Campanaro et al. | 482/95 |
| 6,966,871 | B2 | 11/2005 | Parmater | |
| 7,220,221 | B2 | 5/2007 | Mosimann et al. | |
| D544,050 | S | 6/2007 | Webber | |
| 7,270,628 | B2 * | 9/2007 | Campanaro et al. | 482/95 |
| D574,901 | S | 8/2008 | Campanaro et al. | |
| D585,947 | S | 2/2009 | Royster | |
| 7,503,880 | B2 * | 3/2009 | Campanaro et al. | 482/96 |
| D608,401 | S * | 1/2010 | Campanaro et al. | D21/687 |
| D612,000 | S * | 3/2010 | Campanaro et al. | D21/687 |
| 7,722,512 | B2 * | 5/2010 | Liang et al. | 482/130 |
| 2001/0056011 | A1 | 12/2001 | Endelman et al. | |
| 2002/0082146 | A1 | 6/2002 | Stearns | |
| 2005/0148437 | A1 * | 7/2005 | Ryan et al. | 482/37 |
| 2005/0159277 | A1 * | 7/2005 | McVay et al. | 482/142 |
| 2005/0159278 | A1 * | 7/2005 | McVay et al. | 482/142 |
| 2007/0093369 | A1 | 4/2007 | Bocchicchio | |
| 2007/0111866 | A1 * | 5/2007 | McVay et al. | 482/95 |
| 2008/0161173 | A1 * | 7/2008 | Campanaro et al. | 482/133 |
| 2008/0200317 | A1 * | 8/2008 | Campanaro et al. | 482/140 |
| 2009/0018000 | A1 * | 1/2009 | Brown et al. | 482/140 |
| 2009/0181834 | A1 * | 7/2009 | Campanaro et al. | 482/96 |
| 2010/0062916 | A1 * | 3/2010 | Campanaro et al. | 482/142 |

FOREIGN PATENT DOCUMENTS

| | | |
|---|---|---|
| JP | D1331682 | 6/2008 |
| TW | 589088 | 4/1992 |

* cited by examiner

INCLINABLE EXERCISE DEVICE WITH ABDOMINAL CRUNCH EXERCISE ACCESSORY APPARATUS AND METHOD

RELATED APPLICATION

The present application claims priority to U.S. provisional patent application Ser. No. 61/158,045 filed Mar. 6, 2009, which is incorporated herein by reference in its entirety.

BACKGROUND

Field of the Invention

The present invention relates, in general, to accessories for an inclinable exercise device and, in particular, to accessories for an inclinable exercise device for exercising one's abdominal muscles and/or back muscles.

SUMMARY

One embodiment of an abdominal crunch exercise accessory apparatus comprises a pair of abdominal crunch boards configured for attachment side-by-side on an inclinable exercise device. The inclinable exercise device includes a vertical support member; an adjustable incline having a first end and a second end, the first end of the adjustable incline adjustably supported by, and vertically movable with respect to, the vertical support member for adjusting the incline of the adjustable incline; a user support platform movably attached to the adjustable incline for movement of the support platform along the adjustable incline. Each abdominal crunch board includes a handle bar and a bracket connected to create a frame that supports a padded board or support. The padded board or support has a bi-laterally symmetrical trapezoidal shape. A pull pin barrel or other fastening mechanism may be provided to detachably connect each abdominal crunch board to the adjustable incline.

Other features and advantages of the present invention will become more readily apparent to those of ordinary skill in the art after reviewing the following detailed description and accompanying drawings.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Figures 1, 8:
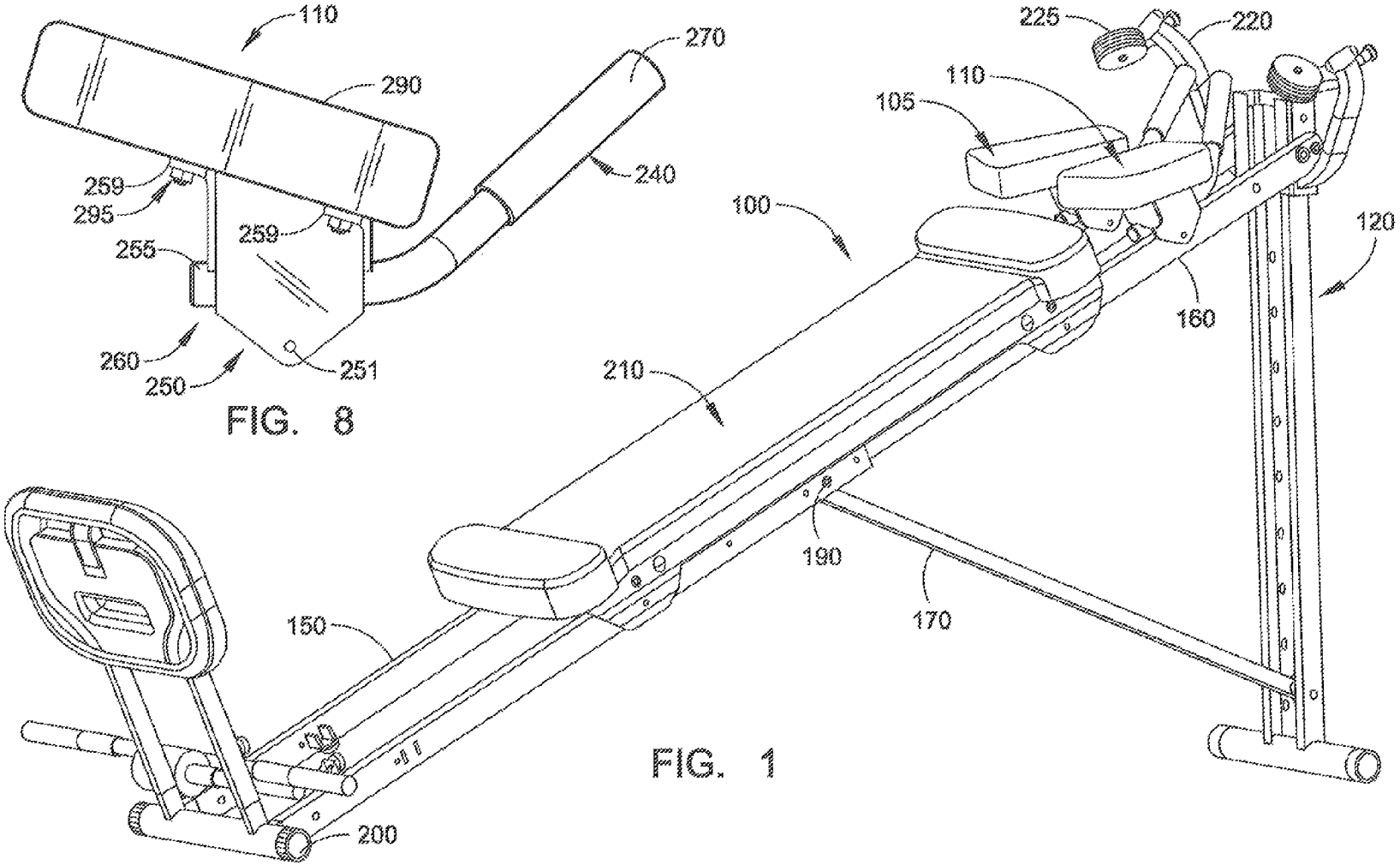
FIG. 1 is a perspective view of an embodiment of an inclinable exercise device including an embodiment of an abdominal crunch exercise accessory apparatus mounted to top rails of the inclinable exercise device.
FIG. 8 is a left side elevational view of the abdominal crunch board illustrated in FIGS. 3 to 7.

Certain embodiments as disclosed herein provide for an abdominal crunch exercise accessory apparatus removably mountable on an inclinable exercise device including a glide board, to allow the device to be used to perform abdominal crunch exercises, and for a method of using the abdominal crunch accessory device with the inclinable exercise device.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention as set forth in the appended claims.

With reference to FIGS. 1-8, an embodiment of an inclinable exercise device 100 including an embodiment of an abdominal exercise accessory apparatus 105 including a pair of abdominal ("ab") crunch boards 110 and method of using the same will be described.

Before describing the ab crunch boards 110 of the abdominal exercise apparatus 105, the inclinable exercise device 100 will first be generally described. The inclinable exercise device 100 includes a vertical support member in the form of a vertical tower 120. In an alternative embodiment, the tower 120 includes one or more vertical support members. The tower 120 includes vertically spaced catches, latches, hooks or the like.

Lower rails 150 are pivotally coupled to upper rails 160 to form an adjustable incline having a first end and a second end. A strut 170 is pivotably coupled to a lower part of tower 120 and is also pivotably connected to a rail pivot point 190. Lower ends of lower rails 150 terminate at a base tube 200. A user support platform or glideboard 210 with rollers (not shown) rolls along the rails 150, 160.

Pulley supports 220 are connected to upper ends of upper rails 160. Attached to the pulley supports 220 are pulleys 225. Although not shown, a connector extends through the pulleys and connects to an upper end of the glideboard 210. The connector may be of any suitable well-known type, but is preferably a cable with handles at each end. The cable extends through the pulleys 225 connected to the upper ends of the upper rails 160 and loops through a third pulley (not shown) attached to an upper end of the glideboard 210. The third pulley is positioned along the lateral centerline of the glideboard 210. This position allows for unilateral (i.e. one arm), bilateral (i.e., two arm) and static equilibrium (i.e. holding the glideboard 210 suspended by keeping a constant force on each handle) use. The cable should preferably be of sufficient length to extend through the pulleys 225 and allow the exerciser to grasp one or both of the handles while the exerciser is on the glideboard 210 and the glideboard 210 is at rest.

In an alternate embodiment, the connector is two separate cables extending through the pulleys connected to the upper ends of the upper rails 160 with each cable fixedly attached to an upper end of the glideboard 210.

A user adjusts the incline of the rails 150, 160 to adjust the resistance level of the inclinable exercise device 100. To adjust the incline of the rails 150, 160, a user lifts the upper ends of the upper rails 160 so that the upper ends of the upper rails 160 are disengaged from (i.e., lifted off of) catches, latches, hooks or the like of the tower 120. The rails 150, 160 are then positioned at the desired level/incline relative to the tower 120 and the upper ends of the upper rails 160 are engaged with the catches, latches, hooks or the like of the tower 120.

Figures 3, 4, 5, 6, 7:
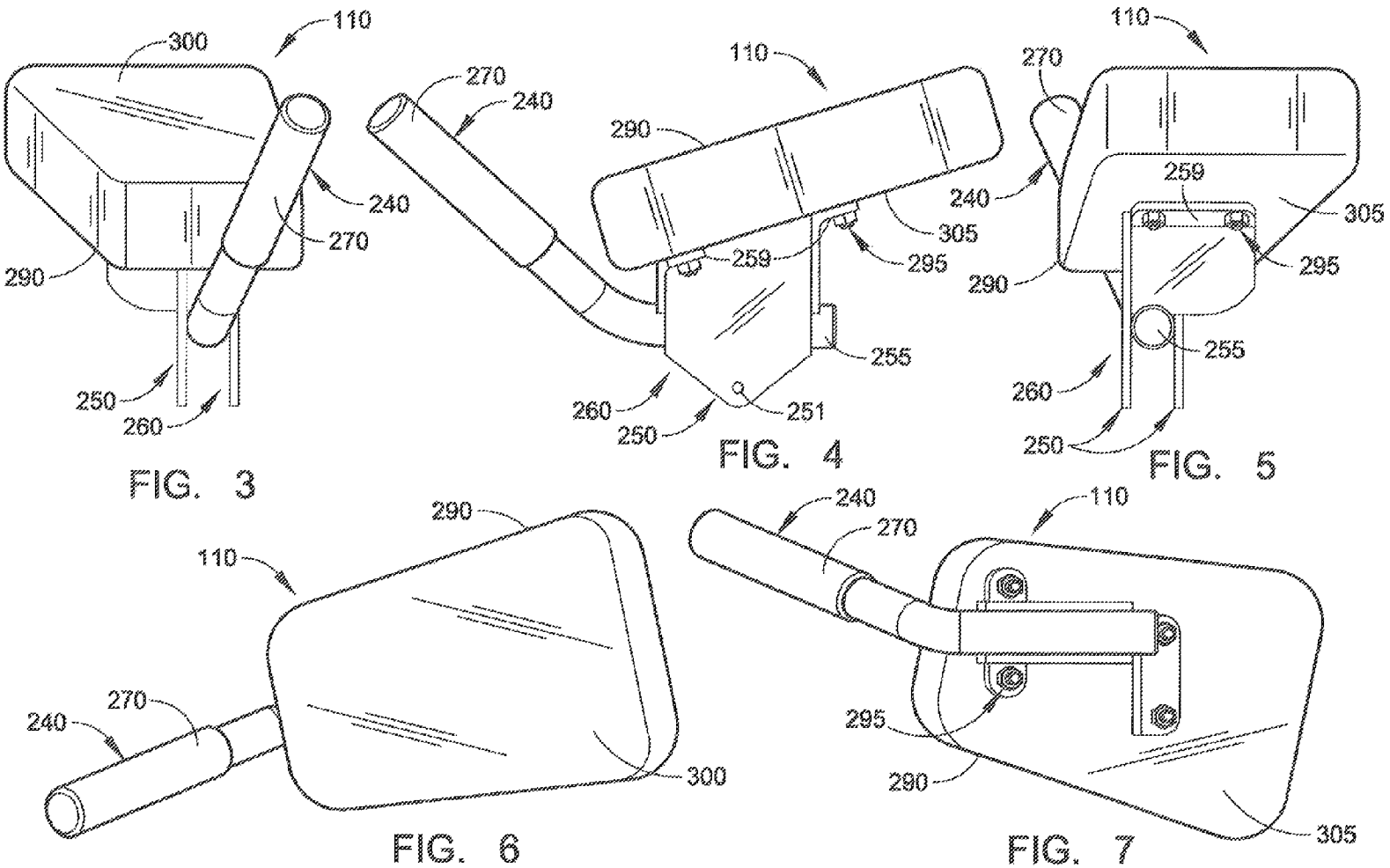
FIG. 3 is a rear elevational view of one of the pair of abdominal crunch boards of the abdominal exercise accessory apparatus illustrated in FIGS. 1 and 2.
FIG. 4 is a right side elevational view of the abdominal crunch board of FIG. 3.
FIG. 5 is a front elevational view of the abdominal crunch board.
FIG. 6 is a top plan view of the abdominal crunch board.
FIG. 7 is a bottom plan view of the abdominal crunch board.

The abdominal exercise accessory apparatus 105 includes a pair of ab crunch boards 110 that are mirror images of each other. Because the ab crunch boards 110 are mirror images of each other, only one of the ab crunch boards 110 will be described. The ab crunch board 110 includes a support frame 260 with a pair of mounting or attachment brackets 250 welded to a straight terminating engagement portion 255 of a handle bar 240 to create a frame 260. The handle bar 240 has a shallow substantially V-shape with a padded hand grip portion 270. An upholstered padded board or support 290 is connected to a board supporting portion 259 of the frame 260 via fasteners 295. Upper surface 300 and lower surface 305 of upholstered padded board or support 290 have a bi-laterally symmetrical trapezoidal shape with angled sides and a first end closest to hand grip portion 270 which is narrower than the opposite or second end, as illustrated in FIGS. 6 and 7. Brackets 250 each have a fastener portion having a fastener hole 251 for receiving a fastener such as a pin to secure the brackets to the rails of the adjustable incline. A fastening pin (see short hitch pin P, FIG. 9) may be used for connecting the ab crunch board 110 to the rail 150, 160. Alternatively, a pull pin barrel may be connected (e.g., welded) to a bottom of the bracket 250 and include a spring-loaded pull pin that engages the hole in the bracket 250 for connecting the ab crunch board 110 to the rail 150, 160. In one embodiment, the pin may extend through the rail and the holes 251 in both brackets 250. Alternatively, only one bracket may be secured to the rail. Other fastener mechanisms may be used in alternative embodiments.

The ab crunch boards 110 are installed on either the upper rails 160 (FIGS. 1, 2), with the hand grip portions 270 facing upwards towards the tower 120 and adjacent to the upper ends of the upper rails 160, or on the lower rails 150, with the hand grip portions 270 facing downwards towards the base tube 200 and adjacent to the lower ends of the lower rails 150 for different exercises.

To install each ab crunch board 110 onto the rails 150, 160, the pin P is removed, each ab crunch board 110 is lowered onto the rail 150, 160, and the pin P is inserted through the hole in the bracket 250 and a mounting hole in the rail 150, 160, causing each ab crunch board 110 to be locked to the rail 150, 160. Each ab crunch board 110 is secured to the rails 150, 160 with the lower surface of the terminating engagement portion 255 resting on top of the rail 150, 160. In embodiments of the rails 150, 160 where the rails do not have mounting holes, each ab crunch board 110 may include socket mounts to mount each ab crunch board 110 to the rails 150, 160.

Figure 2:
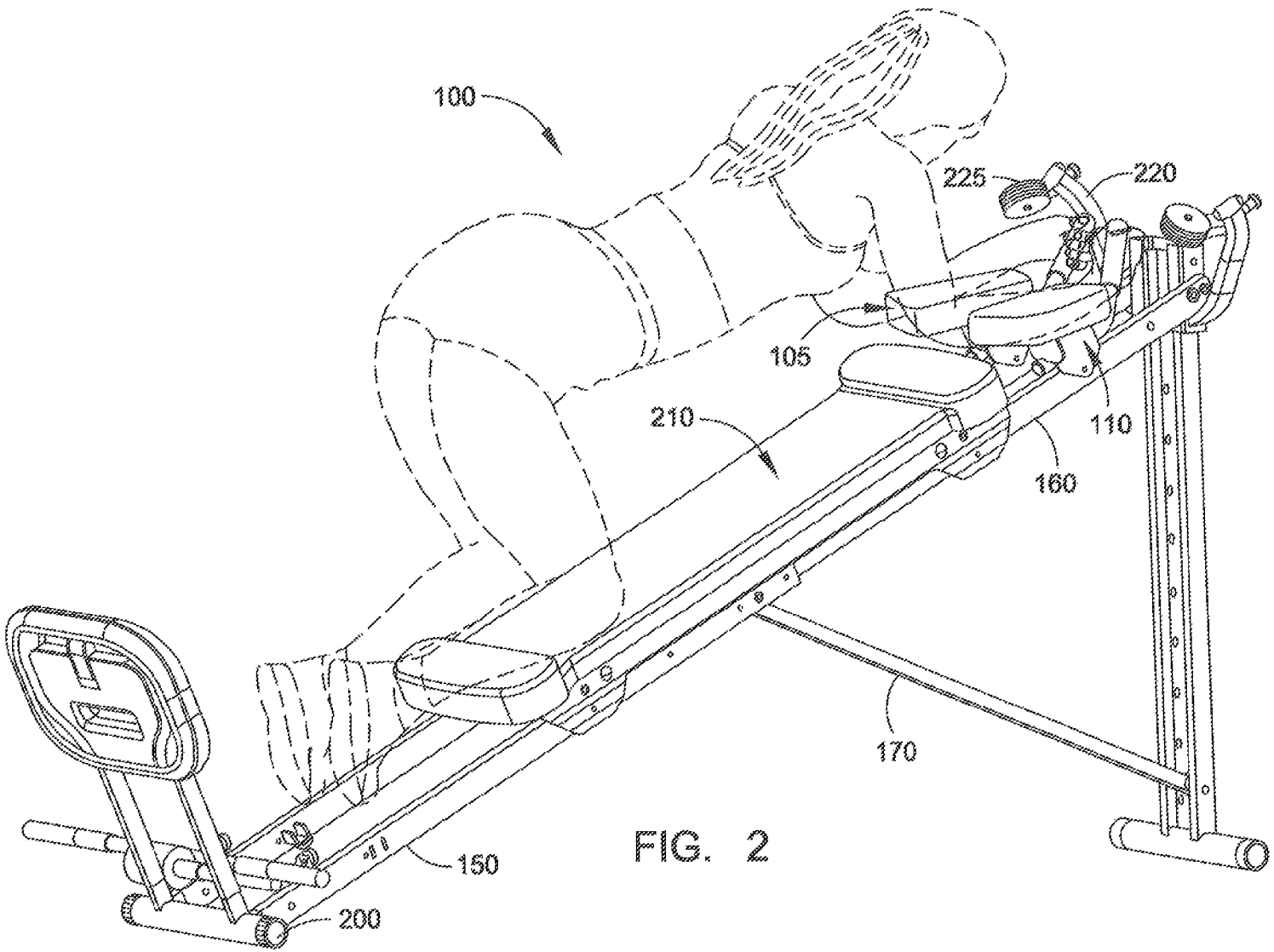
FIG. 2 is a perspective view of the inclinable exercise device including the abdominal crunch exercise accessory apparatus and shows a user on the inclinable exercise device using the abdominal crunch exercise accessory apparatus.

As illustrated in FIGS. 4 and 8, the board supporting portion or portions 259 of support frame 260 extend at an angle to the rail engagement portion 255 of the handle bar, so that the padded board 290 is at an angle to the rail 150 or 160 when installed as in FIG. 1. The hand grip portions 270 of the handle bars extend upwardly from a forward or first end of each padded board, as illustrated in FIG. 8, while the board is angled down towards the handle bar. When the boards are installed with the portion 255 resting on the upwardly or downwardly inclined rail, the boards and handles are oriented at a comfortable angle for a user to rest their forearms on boards 290 while gripping hand grip portions 270 as in FIG. 2, with the first ends of the boards closer to the inclined rails 160 than the opposite, second ends, as can be seen in FIGS. 1 and 2.

With reference to FIGS. 9-17, another embodiment of an abdominal crunch exercise device 308 will be described. The abdominal exercise apparatus 308 includes a pair of ab crunch boards 310 that are mirror images of each other. Because the ab crunch boards 310 are mirror images of each other, only one of the ab crunch boards 310 will be described. The ab crunch board 310 includes a support frame 460 having an upper bracket 472 connected to padded board 490 and a lower bracket 450 connected to a straight portion 455 of the handle bar 440. Upper surface 500 and lower surface 505 of upholstered padded board or support 490 have a bi-laterally symmetrical trapezoidal shape.

Figures 9, 17:
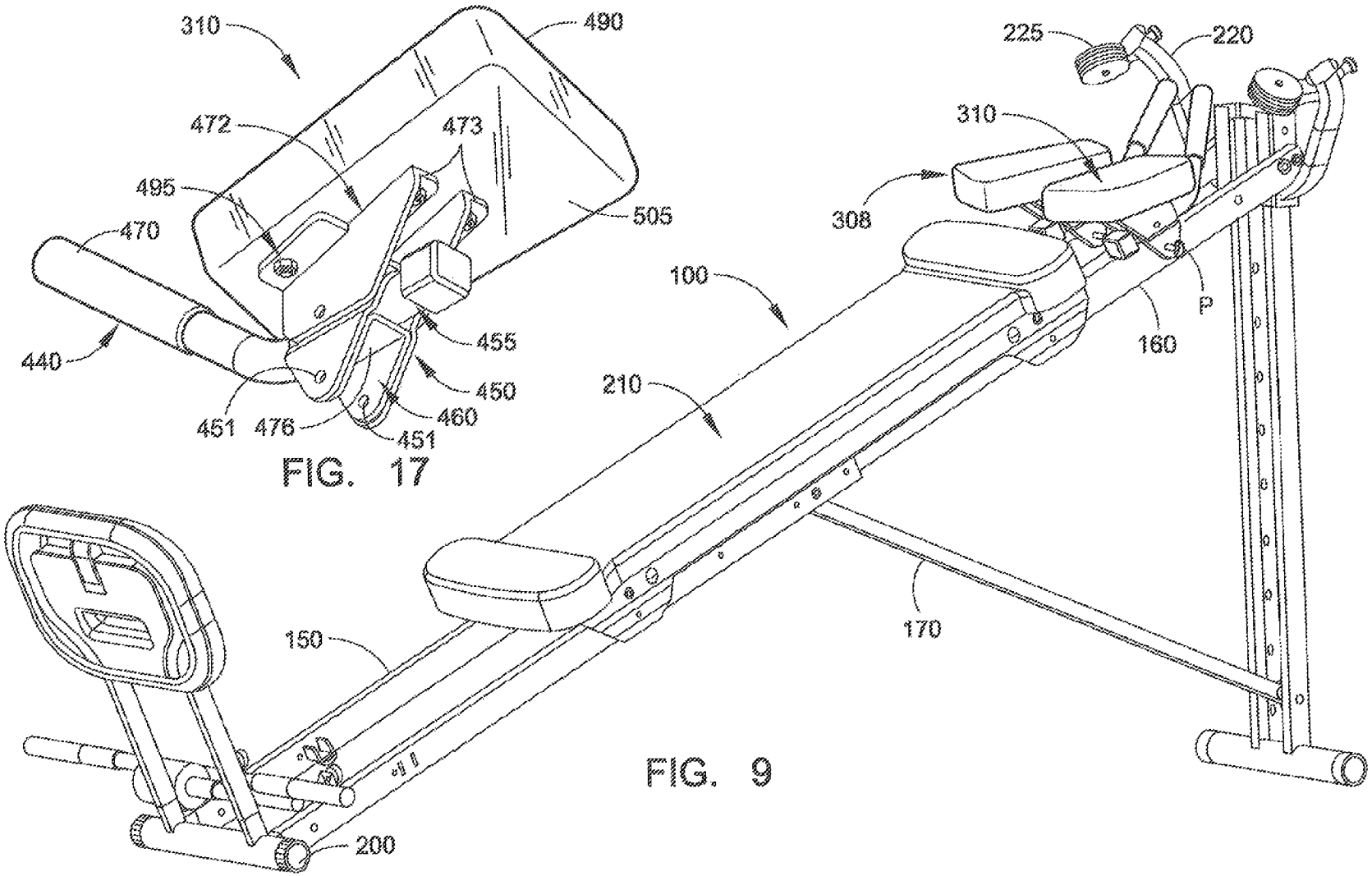
FIG. 9 is a perspective view of the inclinable exercise device of FIG. 1 and shows another embodiment of an abdominal crunch exercise accessory apparatus comprising abdominal crunch boards mounted to top rails of the inclinable exercise device.
FIG. 17 is a perspective view of the abdominal crunch board.
Figures 10, 16:
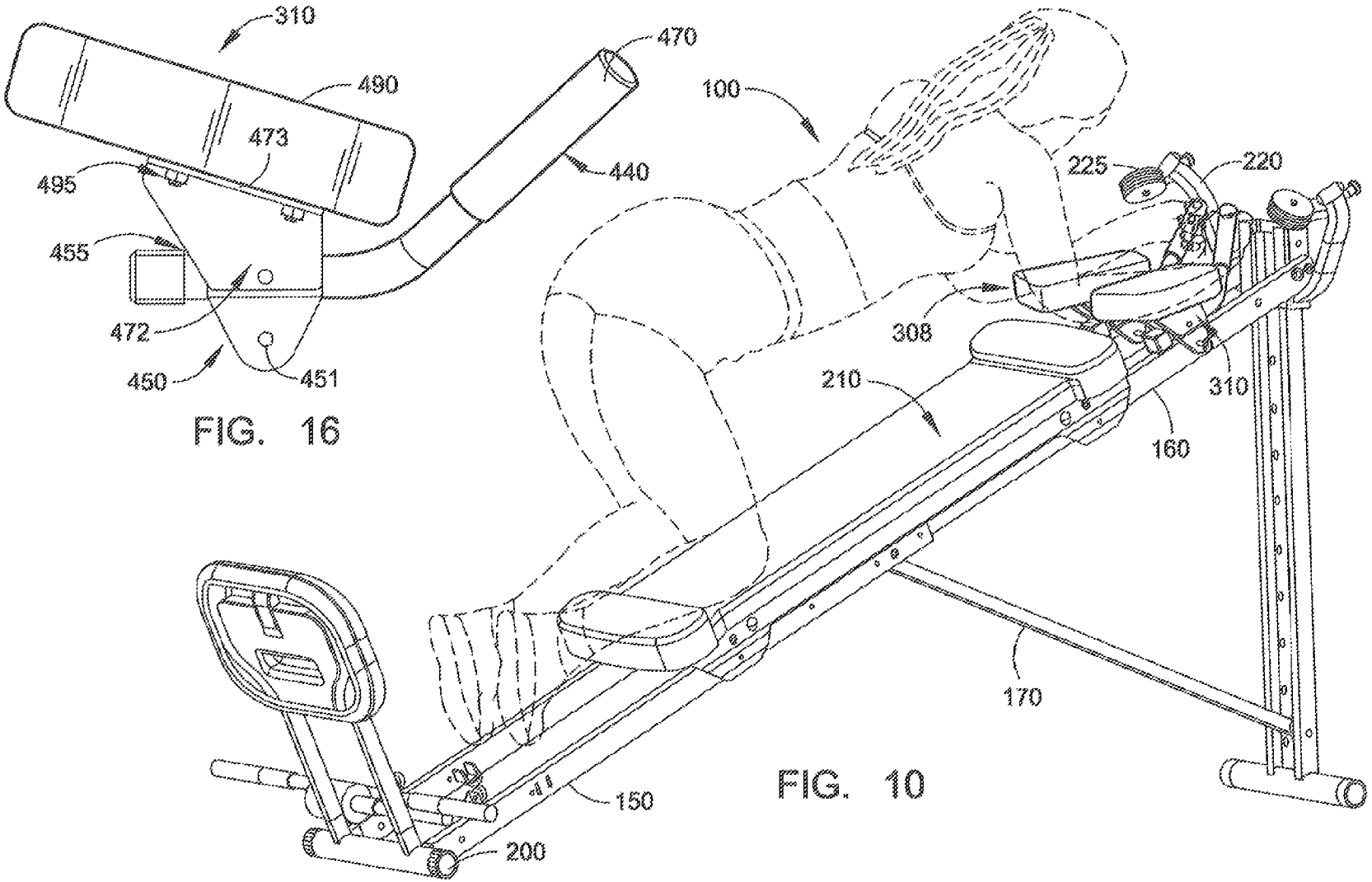
FIG. 10 is a perspective view of the inclinable exercise device including the abdominal crunch boards, as discussed above with respect to FIG. 9, and shows a user on the inclinable exercise device using the abdominal crunch boards.
FIG. 16 is a left side elevational view of the abdominal exercise apparatus illustrated in FIGS. 9 and 10.
Figure 13:
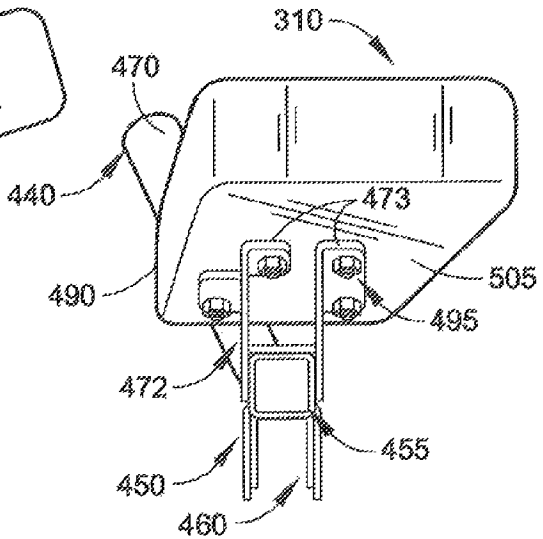
FIG. 13 is a front elevational view of the abdominal crunch board illustrated in FIGS. 11 and 12.
Figure 12:
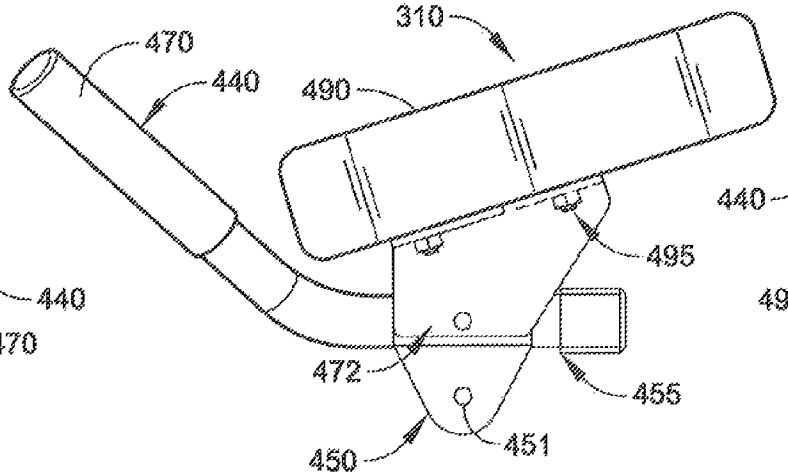
FIG. 12 is a right side elevational view of the abdominal crunch board illustrated in FIG. 11.
Figure 11:
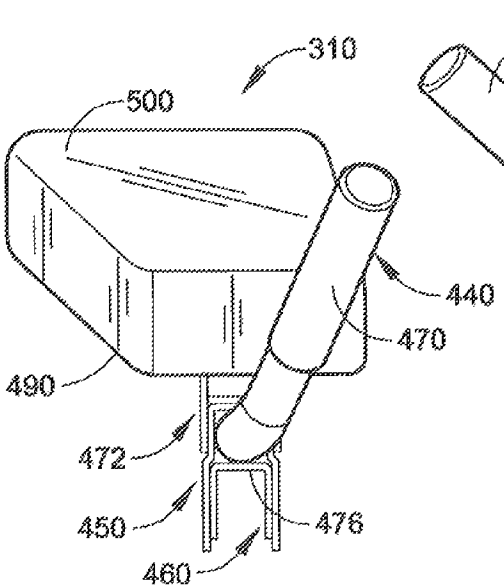
FIG. 11 is a rear elevational view of one of the abdominal crunch boards illustrated in FIGS. 9 and 10.
Figure 15:
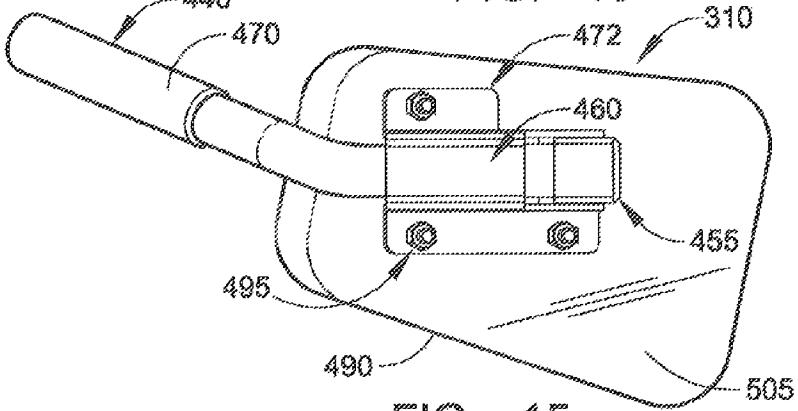
FIG. 15 is a bottom plan view of the abdominal crunch board.
Figure 14:
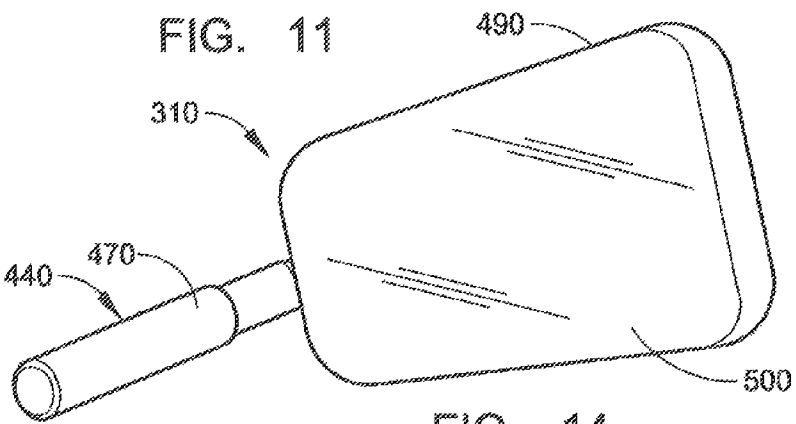
FIG. 14 is a top plan view of the abdominal crunch board illustrated in FIGS. 11 to 13.

The handle bar 440 has a shallow substantially V-shape with a padded hand grip portion 470. An upper bracket 472 has an angled board supporting portion 473 connected to lower surface 505 of the upholstered padded board or support 490 via fasteners 495 (see FIG. 13). The upper bracket 472 includes side walls with holes therein. The upper bracket connects to the lower bracket 450 by means of side walls of the upper bracket 472 extending over the lower bracket 450. One or more fasteners (e.g., short hitch pin) may be disposed in the holes of side walls of the upper bracket 472 to connect the upper bracket 472 and the lower bracket 450. The lower bracket 450 is generally U-shaped, as illustrated in FIGS. 11 and 13, with downwardly depending side walls on opposite sides of a central rail engagement portion or flange 476. The side walls comprise fastener portions having holes 451 for attachment to a rail of the adjustable incline. The upper bracket 472, the lower bracket 450, and the handle bar 440 together form a frame 460 for the upholstered padded board or support 490. Fastening pin P (e.g., short hitch pin) may be used for connecting the ab crunch board 310 to the rail 150, 160. The pin P is inserted through the holes 451 of the lower bracket 450 and through holes in the rail 150, 160 to connect the ab crunch board 310 to the rail 150, 160, as illustrated in FIG. 9.

The ab crunch boards 310 are installed on either the upper rails 160 (FIGS. 1, 2), with the hand grip portions 470 facing upwards towards the tower 120 and adjacent to the upper ends of the upper rails 160, or on the lower rails 150, with the hand grip portions 470 facing downwards towards the base tube 400 and adjacent to the lower ends of the lower rails 150 for different exercises.

After the upper bracket 472, the lower bracket 450 and handle bar 440, and the upholstered padded board or support 490 are assembled together, each ab crunch board 310 is installed onto the rails 150, 160. In this embodiment, the rail engagement portion of board 110 comprises a lower surface of flange 476 of the lower bracket 450. As in the previous embodiment, the board supporting portion 473 of the support frame is at an angle to the rail engagement portion 476. The pin P (e.g., short hitch pin) is removed and each ab crunch board 310 is lowered onto the rails 150 or 160 and the pin P is inserted through the hole in the lower bracket 450 and a mounting hole in the rail 150, 160, causing each ab crunch board 310 to be locked to the rail 150, 160. Each ab crunch board 310 is secured to the rails 150, 160 with a lower surface of a top flange 476 of the lower bracket 450 resting on top of the rail 150, 160. In embodiments of the rails 150, 160 where the rails do not have mounting holes, each ab crunch board 310 may include socket mounts to mount each ab crunch board 310 to the rails 150, 160.

As illustrated in FIGS. 3 and 11, the hand grip portions 270, 470 of the handle bars in both embodiments are configured to extend at an angle to the forward ends of the padded boards 290, 490, respectively. The orientation of the hand grip portions is such that they are angled inwardly towards one another when the boards are installed on the adjustable incline rails, as illustrated in FIGS. 1, 2, 9, and 10, at a convenient orientation for gripping by the hands of a user positioned on the user support platform 210 as in FIGS. 2 and 10.

Figure 18A:
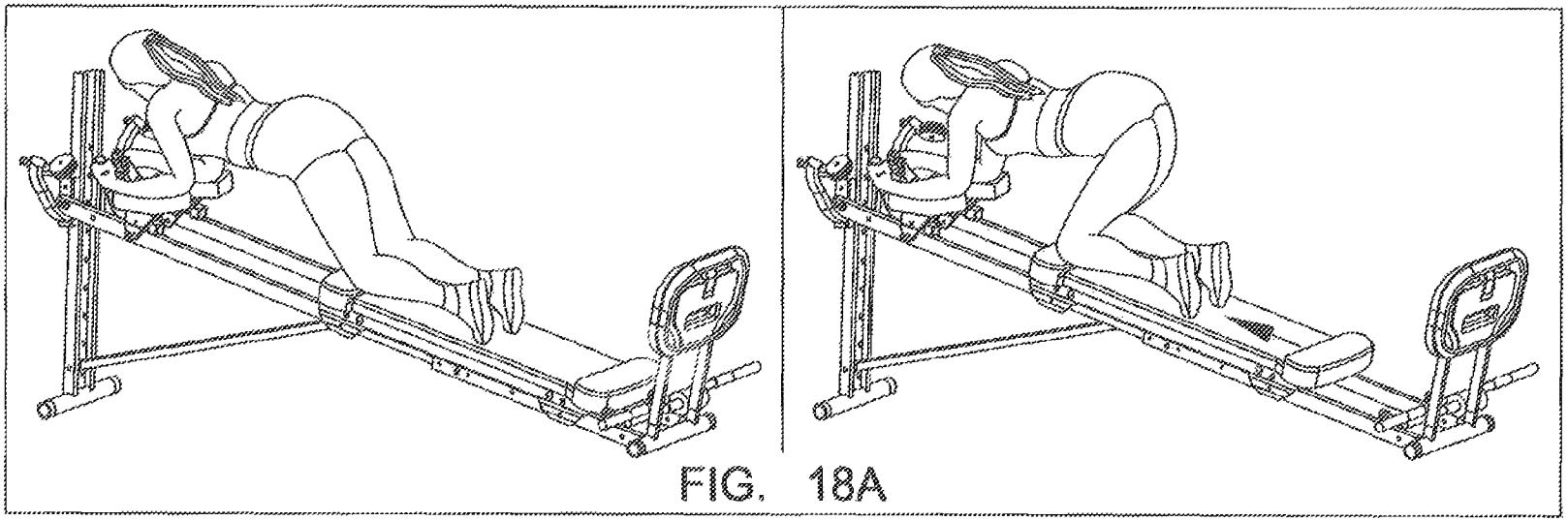
FIGS. 18A to 18J illustrates and describes a variety of different exercises using the abdominal exercise accessory apparatus and inclinable exercise device shown in FIGS. 1, 2, 9, and 10.
Figure 18B:
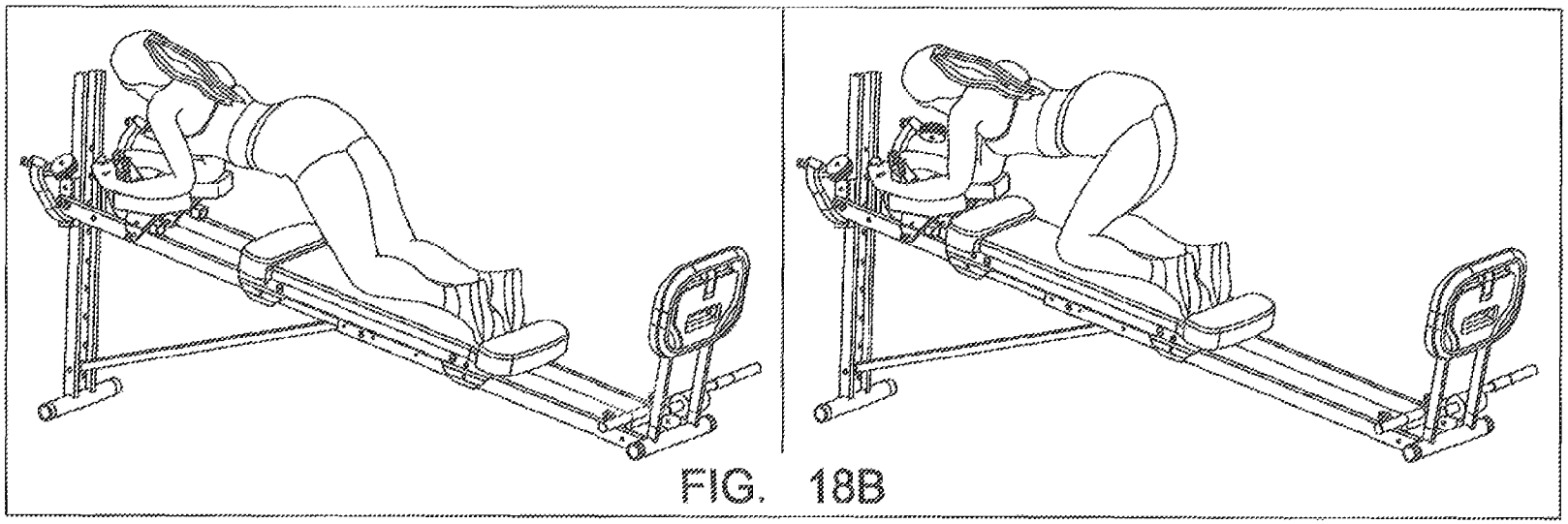
Figure 18C:
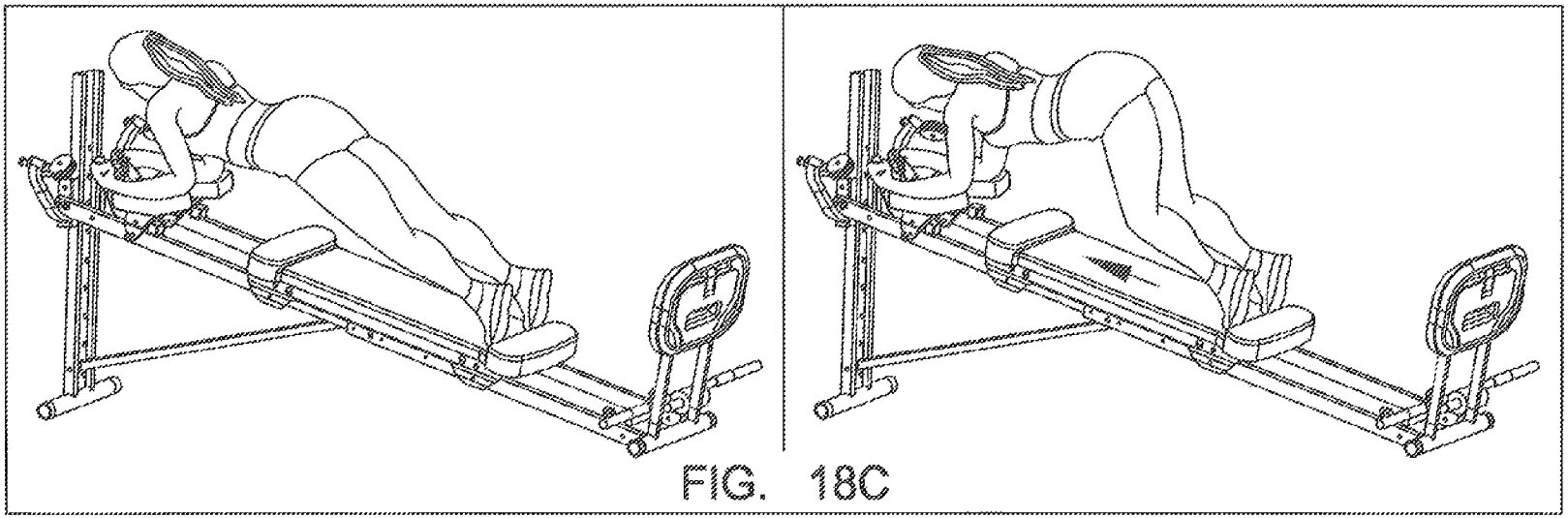
Figure 18D:
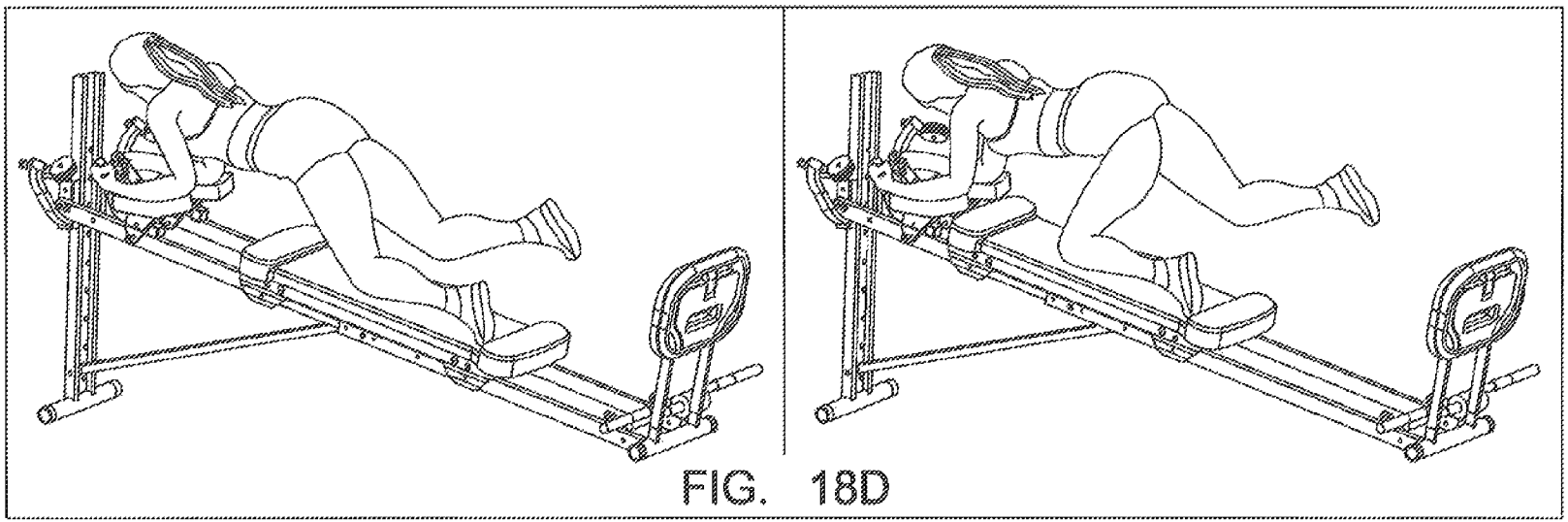
Figure 18E:
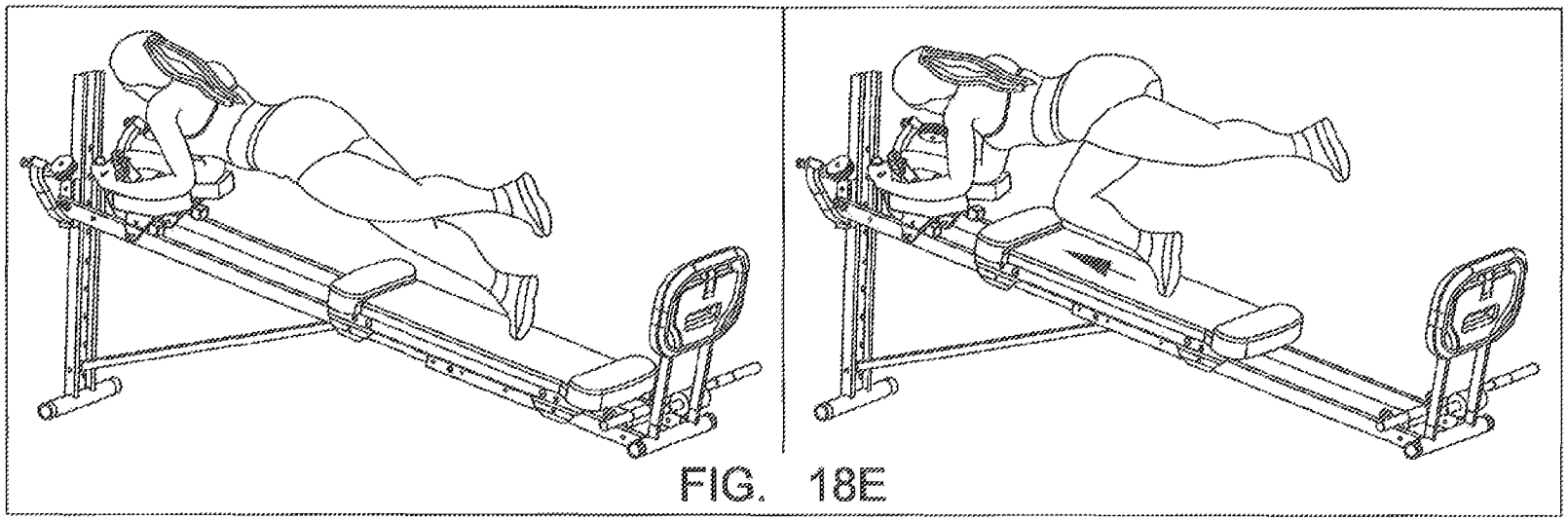
Figure 18F:
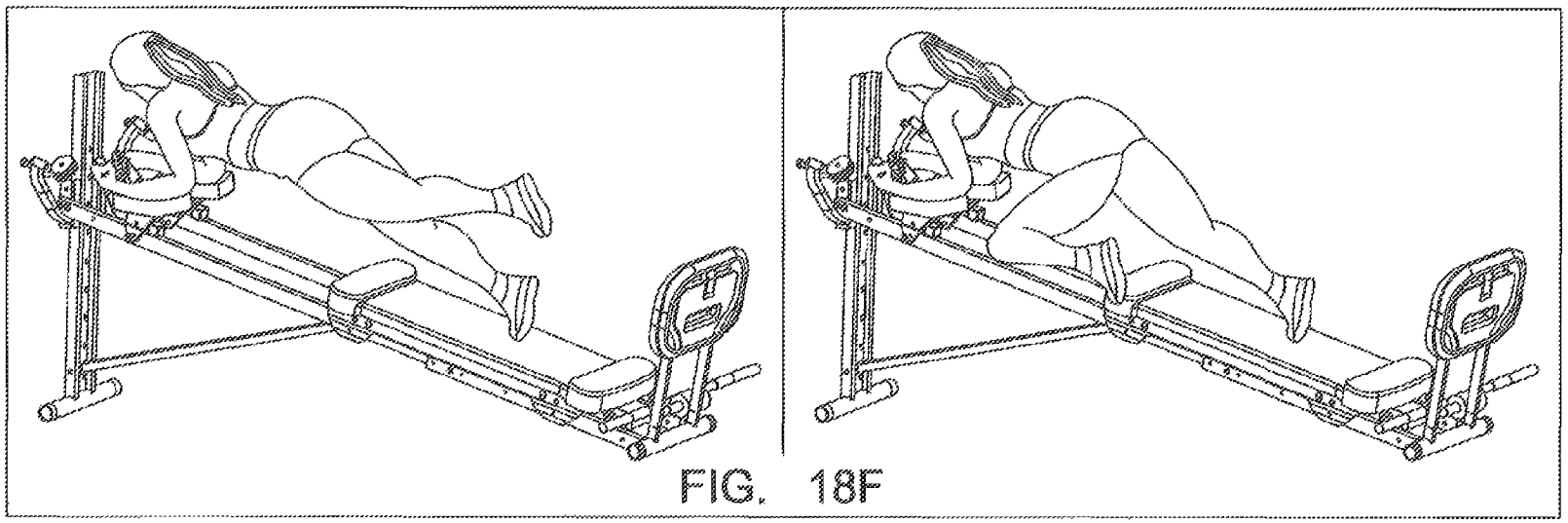

With reference to FIGS. 2 and 9, a method of exercising using the ab crunch boards 110, 310 installed near the upper ends of upper rails 160 will be described. With the cable(s) and handles removed from the inclinable exercise device 100, a user exercises one's abdominal and oblique muscles in calibrated loaded contractions depending on the level of incline of the rails 160, 160 with respect to the tower 120. A straight-on ab pull is performed by the user holding the hand grip portions 270, 470 of the respective ab crunch boards 110, 310 with their hands and resting the forearms on the upper surface 300, 500 of the padded board 290, 490. The user then lies flat (downward facing) on the movable glideboard 210 and grips the hand grip portions 270, 470. The user then crawls or walks their lower body forward on the movable glideboard 210 so that the user is kneeling on the glideboard 210 with the knees near the end of the glideboard 210 closest to the ab crunch board 110, 310, as shown in FIGS. 1, 9. Using primarily abdominal muscles, the user tries to pull their knees into the chest. This causes the glideboard to move forward so the knees (with the glideboard 210) move under the user's torso. In an exemplary method, this is performed with the user's feet off the glideboard 210. This method of exercising the abdominal muscles allows users to work almost their complete range of body motion at more or less resistance (i.e., by adjusting the incline of the rails 150, 160). Examples of this ab crunch exercise are illustrated in FIGS. 18A to 18C, each illustrating a start and end position but with increasing difficulty level, with the user lifting their body up onto their toes in the highest difficulty version of FIG. 18C. FIGS. 18D to 18F illustrate equivalent ab crunch exercises but using only one leg, with the other leg lifted straight up and extended out straight. In the advanced exercise of FIG. 18F, the straight leg is pulled into the chest each time the glide board is brought down. The single leg crunch exercise can be carried out alternately with left and right legs engaging the glideboard or support platform 210.

Figure 18G:
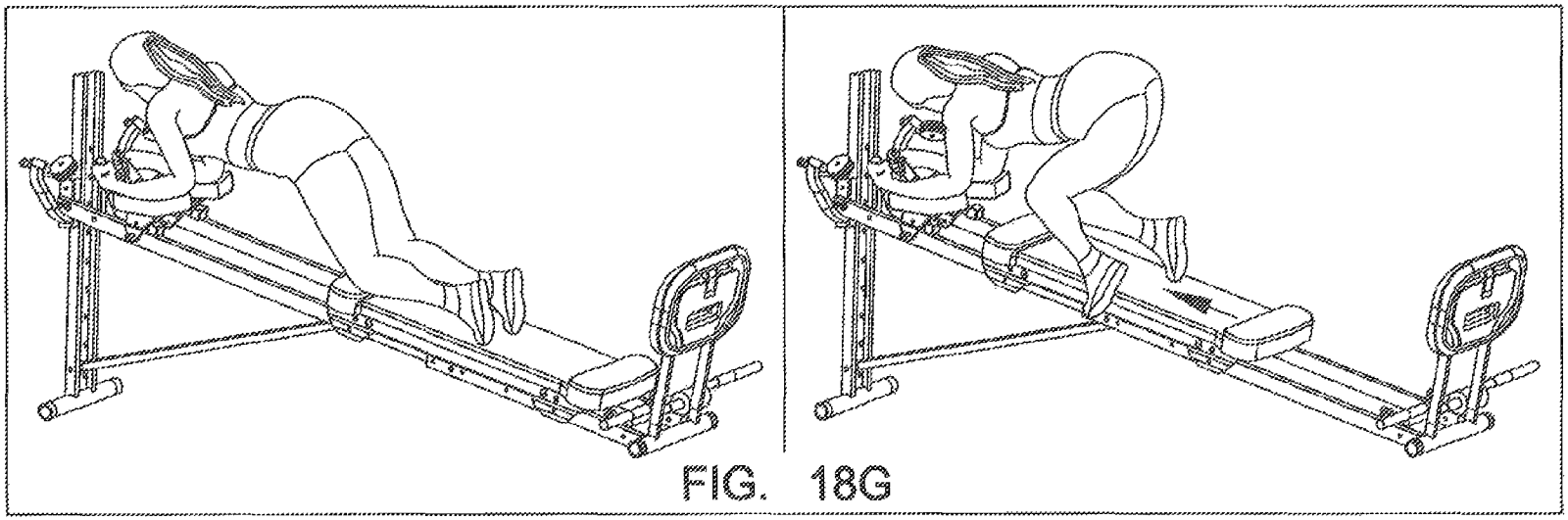
Figure 18H:
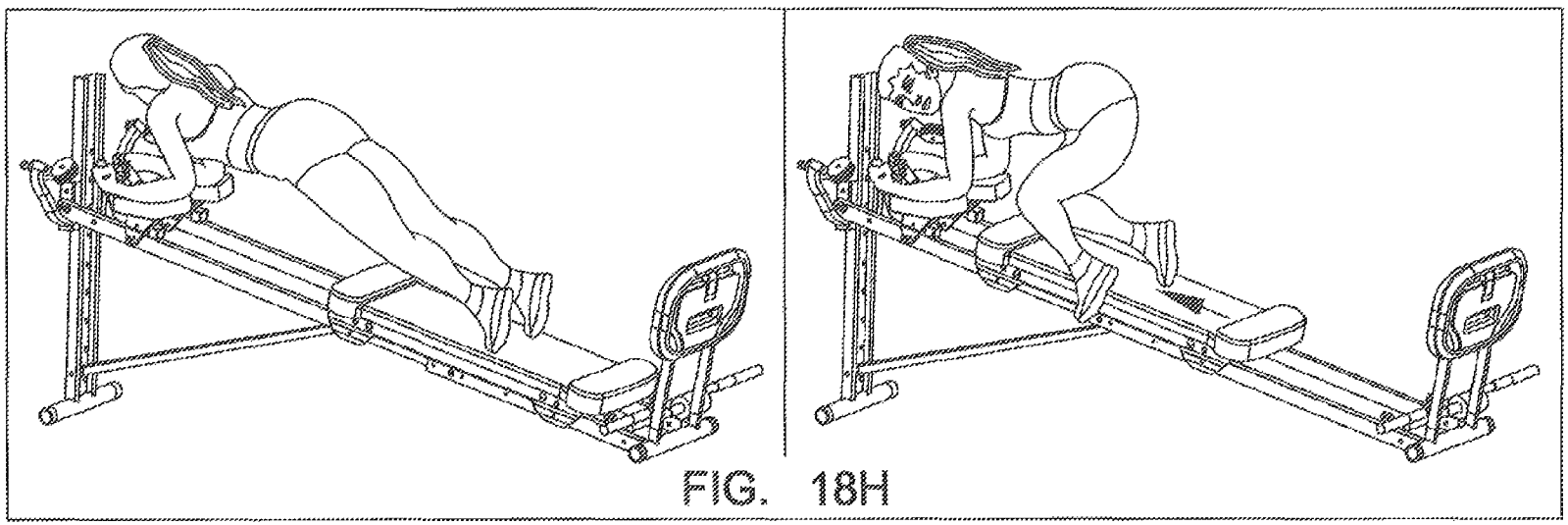

In another method of exercising using the ab crunch board 110, 310, a user exercises the obliques in a similar manner by kneeling on the glideboard 210, but with the torso twisted to the side, as illustrated in FIGS. 18G and 18H, with FIG. 18H illustrating the most difficult version of this exercise. The user grips the respective hand grip portions 270, 470 with the forearms rested on padded boards 290, 490 and pulls their knees up towards the chest again. Using primarily oblique muscles, the user tries to pull their knees into the chest. This causes the glideboard 210 to move forward so the user's knees (with the glideboard 210) move under the torso. In an exemplary method, this is performed with the user's feet off or partially off the side of the glideboard 210.

Figure 18I:
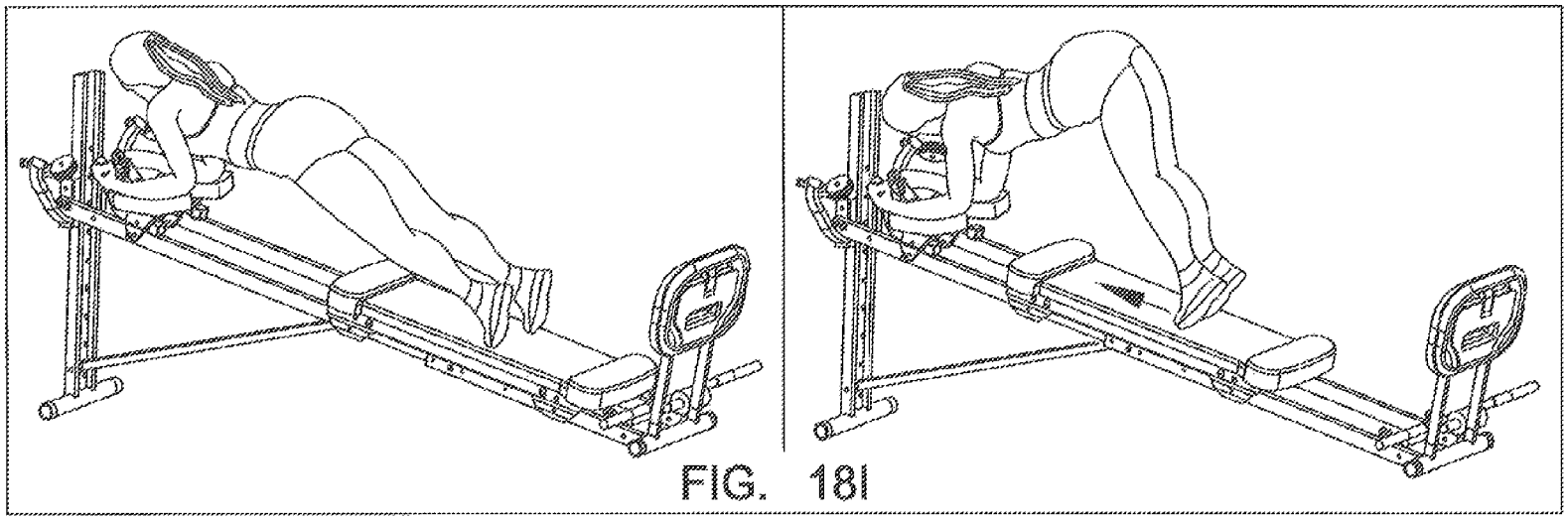
Figure 18J:
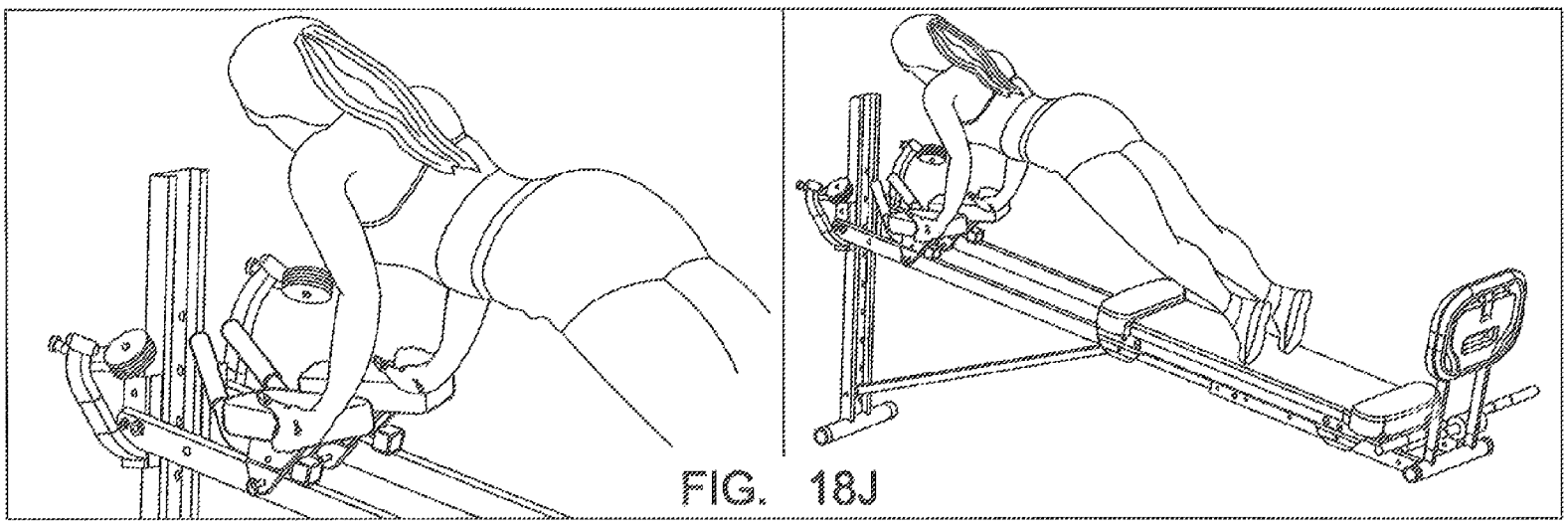

FIG. 18I illustrates performance of a pike exercise. In this exercise, a user first positions their knees towards the top of the glideboard with their hands and forearms in the proper position on the ab crunch boards. They then lift their body up to their toes and pull the lower body toward the hands with the legs straight, so that the user's body form an inverted V as shown on the right. This exercise may also be performed with the hands grasping the sides of the padded boards, rather than with the forearms resting on the boards, as indicated in FIG. 18J.

In a further method of exercising using the ab crunch board 110, 310 (not illustrated) a user works the lower back and upper abdominal muscles in extension by exercising using the ab crunch boards 110, 310 installed near the lower ends of the lower rails 150, with the hand grip portions 270, 470 facing downwards towards the base tube 200. To do this exercise, the user lies down on the glideboard 210 facing down and grasps the respective hand grip portions 270, 470 with their forearms rested on padded board 290, 490. The glideboard 210 is then pushed up, away from the ab crunch boards 110, 310, and the user crawls or walks their knees or feet down the glideboard 210 until the glideboard 210 is as far away from the user's arms as possible and the user's body is substantially level with the rails 150, 160. The user may lift their feet off the glideboard 210 so that the user's knees support their weight on the glideboard 210. Then the user pulls the hips upwards, away from the rails 150, 160, allowing the glideboard 210 to roll down the rails 150, 160 towards the ab crunch board 110, 310. An advance version includes keeping the legs straight so that the user's feet support the user's weight on the glideboard 210 and the user lifts their forearms off the respective padded boards 290, 490 so that the user only holds onto (and contacts) the hand grip portions 270, 470.

The ab crunch boards 110, 310 in conjunction with the inclinable exercise device 100 allow a user to perform a wide variety of downward-facing crunch exercises to exercise abdominal muscles, oblique muscles, lower back muscles, and other muscles with almost a complete range of body motion and at multiple different resistance levels. For example, but not by way of limitation, with reference to FIGS. 18A to 18J, a variety of different exercises using the ab crunch boards 110, 310 in conjunction with the inclinable exercise device 100 are shown and described above.

The above figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. An abdominal crunch exercise accessory apparatus for an inclinable exercise device, the inclinable exercise device including a vertical support member; an adjustable incline having a top end and a bottom end, the top end of the adjustable incline adjustably supported by, and vertically movable with respect to, the vertical support member for adjusting the incline of the adjustable incline; and a user support platform movably attached to the adjustable incline for movement of the support platform along the adjustable incline, the accessory apparatus comprising:

a pair of abdominal crunch boards each comprising a support frame, a padded board secured to the support frame and configured to support a respective one of the user's forearms, and a handle bar secured to the support frame, the handle bar having a hand grip portion positioned for gripping by one of the user's hands when their forearm rests on the padded board;

the support frame of each abdominal crunch board having a fastener portion adapted for releasable attachment to at least first and second different positions on the adjustable incline of an inclinable exercise device;

wherein the pair of abdominal crunch boards comprise a two-position abdominal crunch exercise accessory apparatus and are removably attachable side by side on the adjustable incline at a first position between the top end of the adjustable incline and the user support platform or a second position between the bottom end of the adjustable incline and the user support platform, whereby a user positioned on the user support platform can position one forearm on each padded board with their hands gripping the respective hand grip portions of the pair of abdominal crunch boards.

2. The apparatus of claim 1, wherein the handle bar is substantially V-shaped.

3. The apparatus of claim 1, wherein the padded boards are of bi-laterally symmetrical trapezoidal shape.

4. The apparatus of claim 1, further including a pull pin barrel connected to the fastener portion of each abdominal crunch board.

5. The apparatus of claim 1, wherein each abdominal crunch board has an engagement portion configured to rest on top of the adjustable incline when the fastener portion is positioned for releasable attachment to the adjustable incline.

6. The apparatus of claim 5, wherein each handlebar has a first end portion comprising said engagement portion, and a second end portion extending at an angle to the first end portion, the hand grip portion comprising a padded hand grip secured over said second end portion.

7. The apparatus of claim 5, wherein the fastener portion of each abdominal crunch board comprises a generally U-shaped bracket with an upper flange comprising said engagement portion and downwardly depending flanges for engagement over opposite sides of a respective rail of said adjustable incline.

8. The apparatus of claim 5, wherein each padded board has a lower surface, an upper surface configured to engage a user's forearm, opposite sides, and opposite first and second ends, the hand grip portion of each handle bar being located in front of the first end of said padded board.

9. The device of claim 8, wherein the support frame of each abdominal crunch board has a board supporting portion attached to the lower surface of the padded board, the board supporting portion being oriented at an angle to the engagement portion, whereby each padded board is oriented at an angle to the adjustable incline when the abdominal crunch boards are attached to the adjustable incline.

10. The apparatus of claim 8, wherein the first end of each padded board is narrower than the second end.

11. The apparatus of claim 1, wherein said pair of abdominal crunch boards are mirror images of each other.

12. The apparatus of claim 11, wherein the hand grip portions are configured to extend upwardly from the respective padded boards and angle inwardly towards each other when the boards are attached to an adjustable incline.

13. An inclinable exercise apparatus, comprising:

a vertical support member;

an adjustable incline having a top end and a bottom end, the top end of the adjustable incline adjustably supported at a selectable height on the vertical support member to adjust the incline of the adjustable incline;

a user support platform movably attached to the adjustable incline for movement of the support platform along the adjustable incline;

an abdominal crunch accessory apparatus comprising a pair of left and right abdominal crunch boards releasably secured side-by-side at one of at least two different selectable positions on the adjustable incline, the selectable positions comprising a first position between the top end of the adjustable incline and the user support platform and a second position between the bottom end of the adjustable incline and the user support platform; and each abdominal crunch board comprising a support frame, a padded board secured to the support frame which is configured to support a respective one of a user's forearms, and a handle bar secured to the support frame, the handle bar having a hand grip portion for gripping by one of the user's hands when using the board.

14. The apparatus of claim 13, wherein the adjustable incline has rails with fastener openings at predetermined locations corresponding to said first and second positions, each support frame has an attachment bracket positioned adjacent a respective rail and having a fastener opening aligned with a selected fastener opening on said rail, and a releasable pull pin extends through said aligned fastener openings to releasably secure the respective padded board to the adjustable incline.

15. The apparatus of claim 13, wherein each handle bar is substantially V-shaped.

16. The apparatus of claim 13, wherein the padded boards are of bi-laterally symmetrical trapezoidal shape.

17. The apparatus of claim 13, wherein said pair of abdominal crunch boards are mirror images of each other.

18. The apparatus of claim 13, wherein each padded board has opposite first and second ends, the second end being positioned closest to the user support platform, and the board is inclined relative to the adjustable incline whereby the first end is closer to the adjustable incline than the second end.

19. The apparatus of claim 18, wherein the hand grip portion is spaced in front of the first end of the padded board.

20. A method of using a pair of abdominal crunch boards with an inclinable exercise device, the inclinable exercise device including a vertical support member; an adjustable incline having a first end and a second end, the first end of the adjustable incline adjustably supported by, and vertically movable with respect to, the vertical support member for adjusting the incline of the adjustable incline, and a user support platform movably attached to the adjustable incline for movement of the support platform along the adjustable incline, comprising:

removably attaching left and right abdominal crunch boards side-by-side to the adjustable incline at a location between the first end of the adjustable incline and the user support platform or a location between the second end of the adjustable incline and the user support platform;

kneeling on the user support platform;

supporting the left forearm on a padded support of the left abdominal crunch board and supporting the right forearm on a padded support of the right abdominal crunch board; and moving the user support platform and knees together towards the abdominal crunch boards and away from the abdominal crunch boards.

21. The method of claim 20, further comprising gripping a left hand grip of the left abdominal crunch board with the left hand and gripping a right hand grip of the right abdominal crunch board with the right hand while moving the user support platform.

22. The method of claim 20, further comprising removably attaching the crunch boards to a first location on an upper end portion of the adjustable incline and supporting the forearms on the padded supports while performing a first abdominal crunch exercise while facing upwardly in an upwardly inclined orientation, removing the crunch boards from the first location, attaching the crunch boards to a second location on a lower end portion of the adjustable incline, and performing a second abdominal exercise while facing downwardly in a downwardly inclined orientation.

* * * * *